US008746371B2

(12) United States Patent
Gentry

(10) Patent No.: US 8,746,371 B2
(45) **Date of Patent: *Jun. 10, 2014**

(54) DOWNHOLE TOOLS HAVING ACTIVATION MEMBERS FOR MOVING MOVABLE BODIES THEREOF AND METHODS OF USING SUCH TOOLS

(71) Applicant: Baker Hughes Incorporated, Houston, TX (US)

(72) Inventor: Steven Richard Gentry, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/941,944

(22) Filed: Jul. 15, 2013

(65) Prior Publication Data

US 2013/0299245 A1 Nov. 14, 2013

Related U.S. Application Data

(63) Continuation of application No. 12/894,785, filed on Sep. 30, 2010, now Pat. No. 8,485,282.

(60) Provisional application No. 61/247,084, filed on Sep. 30, 2009.

(51) Int. Cl.
*E21B 7/28* (2006.01)
*E21B 10/32* (2006.01)

(52) U.S. Cl.
USPC ..... 175/271; 175/267; 175/269; 175/291

(58) Field of Classification Search
USPC ..... 175/271, 267, 269, 291
See application file for complete search history.

(56) References Cited

U.S. PATENT DOCUMENTS 1,678,075 A 7/1928 Phipps
2,069,482 A 2/1937 Seay (Continued)

FOREIGN PATENT DOCUMENTS

EP 246789 A2 11/1987
EP 1036913 A1 9/2000

(Continued)

OTHER PUBLICATIONS

International Search Report for International Application No. PCT/US2010/050876 mailed May 9, 2011, 3 pages.

(Continued)

*Primary Examiner* — Giovanna Wright
(74) *Attorney, Agent, or Firm* — TraskBritt

(57) ABSTRACT

Expandable reamers for enlarging wellbores include a tubular body and one or more blades configured to extend and retract. A sleeve member within the tubular body has open ends to allow fluid to flow therethrough. A fluid port extends through a wall of the sleeve member. A restriction member within the sleeve is movable between first and second positions. In the first position, fluid flow through the downhole end of the sleeve is generally unimpeded, and fluid flow through the fluid port is generally impeded. In the second position, fluid flow through the downhole end of the sleeve member is generally impeded, and fluid flow through the fluid port is generally unimpeded. The restriction member may be configured to move responsive to changes in the rate of fluid flow through the sleeve member. Methods of using such reamers are also disclosed.

20 Claims, 14 Drawing Sheets

(56) References Cited

U.S. PATENT DOCUMENTS

| | | | |
|---|---|---|---|
| 2,177,721 | A | 10/1939 | Johnson et al. |
| 2,344,598 | A | 3/1944 | Church |
| 2,754,089 | A | 7/1956 | Kammerer, Jr. |
| 2,758,819 | A | 8/1956 | Kammerer, Jr. |
| 2,834,578 | A | 5/1958 | Carr |
| 2,882,019 | A | 4/1959 | Carr et al. |
| 3,105,562 | A | 10/1963 | Stone et al. |
| 3,123,162 | A | 3/1964 | Rowley |
| 3,126,065 | A | 3/1964 | Chadderdon |
| 3,211,232 | A | 10/1965 | Grimmer |
| 3,224,507 | A | 12/1965 | Cordary, Jr. |
| 3,339,647 | A | 9/1967 | Kammerer, Jr. |
| 3,425,500 | A | 2/1969 | Fuchs |
| 3,433,313 | A | 3/1969 | Brown |
| 3,556,233 | A | 1/1971 | Gilreath |
| 4,403,659 | A | 9/1983 | Upchurch |
| 4,458,761 | A | 7/1984 | Van Vreeswyk |
| 4,545,441 | A | 10/1985 | Williamson |
| 4,589,504 | A | 5/1986 | Simpson |
| 4,635,738 | A | 1/1987 | Schillinger et al. |
| 4,660,657 | A | 4/1987 | Furse et al. |
| 4,690,229 | A | 9/1987 | Raney |
| 4,693,328 | A | 9/1987 | Furse et al. |
| 4,842,083 | A | 6/1989 | Raney |
| 4,848,490 | A | 7/1989 | Anderson |
| 4,854,403 | A | 8/1989 | Ostertag et al. |
| 4,884,477 | A | 12/1989 | Smith et al. |
| 4,889,197 | A | 12/1989 | Boe |
| 5,139,098 | A | 8/1992 | Blake |
| 5,211,241 | A | 5/1993 | Mashaw et al. |
| 5,224,558 | A | 7/1993 | Lee |
| 5,265,684 | A | 11/1993 | Rosenhauch |
| 5,293,945 | A | 3/1994 | Rosenhauch et al. |
| 5,305,833 | A | 4/1994 | Collins |
| 5,318,131 | A | 6/1994 | Baker |
| 5,318,137 | A | 6/1994 | Johnson et al. |
| 5,318,138 | A | 6/1994 | Dewey et al. |
| 5,332,048 | A | 7/1994 | Underwood et al. |
| 5,343,963 | A | 9/1994 | Bouldin et al. |
| 5,361,859 | A | 11/1994 | Tibbitts |
| 5,368,114 | A | 11/1994 | Tandberg et al. |
| 5,375,662 | A | 12/1994 | Echols, III et al. |
| 5,402,856 | A | 4/1995 | Warren et al. |
| 5,425,423 | A | 6/1995 | Dobson et al. |
| 5,437,308 | A | 8/1995 | Morin et al. |
| 5,495,899 | A | 3/1996 | Pastusek |
| 5,497,842 | A | 3/1996 | Pastusek |
| 5,553,678 | A | 9/1996 | Barr et al. |
| 5,560,440 | A | 10/1996 | Tibbitts et al. |
| 5,740,864 | A | 4/1998 | de Hoedt et al. |
| 5,788,000 | A | 8/1998 | Maury et al. |
| 5,823,254 | A | 10/1998 | Dobson et al. |
| 5,887,655 | A | 3/1999 | Haugen et al. |
| 5,957,223 | A | 9/1999 | Doster et al. |
| 6,039,131 | A | 3/2000 | Beaton |
| 6,059,051 | A | 5/2000 | Jewkes et al. |
| 6,070,677 | A | 6/2000 | Johnston |
| 6,109,354 | A | 8/2000 | Ringgenberg et al. |
| 6,116,336 | A | 9/2000 | Adkins et al. |
| 6,131,675 | A | 10/2000 | Anderson |
| 6,189,631 | B1 | 2/2001 | Sheshtawy |
| 6,213,226 | B1 | 4/2001 | Eppink et al. |
| 6,227,312 | B1 | 5/2001 | Eppink et al. |
| 6,289,999 | B1 | 9/2001 | Dewey et al. |
| 6,325,151 | B1 | 12/2001 | Vincent et al. |
| 6,360,831 | B1 | 3/2002 | Akesson et al. |
| 6,378,632 | B1 | 4/2002 | Dewey |
| 6,488,104 | B1 | 12/2002 | Eppink et al. |
| 6,494,272 | B1 | 12/2002 | Eppink et al. |
| 6,575,249 | B2 | 6/2003 | Deaton |
| 6,615,933 | B1 | 9/2003 | Eddison |
| 6,668,936 | B2 | 12/2003 | Williamson, Jr. et al. |
| 6,668,949 | B1 | 12/2003 | Rives |
| 6,708,785 | B1 | 3/2004 | Russell et al. |
| 6,732,817 | B2 | 5/2004 | Dewey et al. |
| 7,048,078 | B2 | 5/2006 | Dewey et al. |
| 7,314,099 | B2 | 1/2008 | Dewey et al. |
| 7,513,318 | B2 | 4/2009 | Underwood et al. |
| 8,485,282 | B2 * | 7/2013 | Gentry ..... 175/271 |
| 2002/0070052 | A1 | 6/2002 | Armell |
| 2003/0029644 | A1 | 2/2003 | Hoffmaster et al. |
| 2008/0128169 | A1 | 6/2008 | Radford et al. |
| 2008/0128175 | A1 | 6/2008 | Radford et al. |
| 2009/0032308 | A1 | 2/2009 | Eddison |
| 2009/0145666 | A1 | 6/2009 | Radford et al. |
| 2011/0073370 | A1 | 3/2011 | Gentry |
| 2011/0284233 | A1 | 11/2011 | Wu et al. |

FOREIGN PATENT DOCUMENTS

| | | | |
|---|---|---|---|
| EP | 1044314 | A1 | 3/2005 |
| GB | 2328964 | A | 3/1999 |
| GB | 2344607 | A | 6/2000 |
| GB | 2344122 | B | 4/2003 |
| WO | 0031371 | A1 | 6/2000 |

OTHER PUBLICATIONS

International Written Opinion for International Application No. PCT/US2010/050876 mailed May 9, 2011, 3 pages.

International Preliminary Report on Patentability for International Application No. PCT/US2010/050876 dated Apr. 3, 2012, 5 pages.

* cited by examiner

DOWNHOLE TOOLS HAVING ACTIVATION MEMBERS FOR MOVING MOVABLE BODIES THEREOF AND METHODS OF USING SUCH TOOLS

CROSS-REFERENCE TO RELATED APPLICATIONS

This application is a continuation of U.S. patent application Ser. No. 12/894,785, filed Sep. 30, 2010, now U.S. Pat. No. 8,485,282, issued Jul. 16, 2013. This application claims the benefit of U.S. Provisional Patent Application Ser. No. 61/247,084, filed Sep. 30, 2009, the disclosure of each of which is hereby incorporated herein in its entirety by this reference.

TECHNICAL FIELD

Embodiments of the present invention relate generally to an expandable reamer apparatus for drilling a subterranean borehole and, more particularly, to an expandable reamer apparatus for enlarging a subterranean borehole beneath a casing or liner.

BACKGROUND

Expandable reamers are typically employed for enlarging subterranean boreholes. Conventionally, in drilling oil, gas, and geothermal wells, casing is installed and cemented to prevent the well bore walls from caving into the subterranean borehole while providing requisite shoring for subsequent drilling operations to achieve greater depths. Casing is also conventionally installed to isolate different formations, to prevent cross flow of formation fluids, and to enable control of formation fluids and pressure as the borehole is drilled. To increase the depth of a previously drilled borehole, new casing is laid within and extended below the previous casing. While adding such additional casing allows a borehole to reach greater depths, it has the disadvantage of narrowing the borehole. Narrowing the borehole restricts the diameter of any subsequent sections of the well because the drill bit and any further casing must pass through the existing casing. As reductions in the borehole diameter are undesirable because they limit the production flow rate of oil and gas through the borehole, it is often desirable to enlarge a subterranean borehole to provide a larger borehole diameter for installing additional casing beyond previously installed casing as well as to enable better production flow rates of hydrocarbons through the borehole.

A variety of approaches have been employed for enlarging a borehole diameter. One conventional approach used to enlarge a subterranean borehole includes using eccentric and bi-center bits. For example, an eccentric bit with a laterally extended or enlarged cutting portion is rotated about its axis to produce an enlarged borehole diameter. An example of an eccentric bit is disclosed in U.S. Pat. No. 4,635,738, which is assigned to the assignee of the present invention. A bi-center bit assembly employs two longitudinally superimposed bit sections with laterally offset axes, which, when rotated, produce an enlarged borehole diameter. An example of a bi-center bit is disclosed in U.S. Pat. No. 5,957,223, which is also assigned to the assignee of the present invention.

Another conventional approach used to enlarge a subterranean borehole includes employing an extended bottom-hole assembly with a pilot drill bit at the distal end thereof and a reamer assembly some distance above the pilot drill bit. This arrangement permits the use of any standard rotary drill bit type (e.g., a rock bit or a drag bit), as the pilot drill bit and the extended nature of the assembly permit greater flexibility when passing through tight spots in the borehole as well as the opportunity to effectively stabilize the pilot drill bit so that the pilot drill bit and the following reamer will traverse the path intended for the borehole. This aspect of an extended bottom-hole assembly is particularly significant in directional drilling. The assignee of the present invention has, to this end, designed as reaming structures so called "reamer wings," which generally comprise a tubular body having a fishing neck with a threaded connection at the top thereof and a tong die surface at the bottom thereof, also with a threaded connection. U.S. Pat. Nos. 5,497,842 and 5,495,899, both of which are assigned to the assignee of the present invention, disclose reaming structures including reamer wings. The upper midportion of the reamer wing tool includes one or more longitudinally extending blades projecting generally radially outwardly from the tubular body, and PDC cutting elements are provided on the blades.

As mentioned above, conventional expandable reamers may be used to enlarge a subterranean borehole and may include blades that are pivotably or hingedly affixed to a tubular body and actuated by way of a piston disposed therein as disclosed by, for example, U.S. Pat. No. 5,402,856 to Warren. In addition, U.S. Pat. No. 6,360,831 to Akesson et al. discloses a conventional borehole opener comprising a body equipped with at least two hole opening arms having cutting means that may be moved from a position of rest in the body to an active position by exposure to pressure of the drilling fluid flowing through the body. The blades in these reamers are initially retracted to permit the tool to be run through the borehole on a drill string and, once the tool has passed beyond the end of the casing, the blades are extended so the bore diameter may be increased below the casing. In addition, United States Patent Application Publication No. 2008/0128175 A1, which application was filed Dec. 3, 2007 and entitled "Expandable Reamers for Earth-Boring Applications," discloses additional expandable reamer apparatus.

BRIEF SUMMARY

In some embodiments, the present invention includes expandable reamers for enlarging boreholes in subterranean formations. The expandable reamers include a tubular body, at least one opening in a wall of the tubular body, and at least one blade positioned within the at least one opening in the wall of the tubular body. The at least one blade is configured to move between a retracted position and an extended position. A sleeve member is disposed at least partially within the tubular body. The sleeve member includes an elongated cylindrical wall having open ends to allow fluid to flow through the sleeve member between the open ends. At least one fluid port extends through the elongated cylindrical wall of the sleeve member. At least one movable restriction member is disposed within the sleeve member. A flap is movable between a first position and a second position. When the flap is in the first position, fluid flow through the sleeve member between the open ends thereof is generally unimpeded, and fluid flow through the at least one fluid port extending through the wall of the sleeve member is generally impeded. When the flap is in the second position, fluid flow through the sleeve member between the open ends thereof is generally impeded, and fluid flow through the at least one fluid port extending through the wall of the sleeve member is generally unimpeded. The at least one movable restriction member is biased to the first position and is configured to move substantially completely to the second position when the rate of fluid flow through the sleeve member between the open ends thereof meets or exceeds a selected flow rate.

In additional embodiments, the present invention includes methods of forming expandable reamer apparatuses for enlarging boreholes in subterranean formations. A tubular body is formed to have at least one opening extending through a wall of the tubular body. At least one blade is positioned within the at least one opening in the wall of the tubular body, and the at least one blade is configured to move between a retracted position and an extended position. A sleeve member is formed that comprises an elongated cylindrical wall having open ends to allow fluid to flow through the sleeve member. At least one fluid port is formed or otherwise provided that extends through the elongated cylindrical wall of the sleeve member. At least one movable restriction member is disposed within the sleeve member, and a flap member is configured to move between a first position and a second position. When the flap member is in the first position, fluid flow through the sleeve member between the open ends thereof is generally unimpeded, and fluid flow through the at least one fluid port extending through the elongated cylindrical wall of the sleeve member is generally impeded. When the flap member is in the second position, fluid flow through the sleeve member between the open ends thereof is generally impeded, and fluid flow through the at least one fluid port extending through the elongated cylindrical wall of the sleeve member is generally unimpeded. The at least one movable restriction member is biased to the first position and configured to move completely to the second position when the rate of fluid flow through the sleeve member between the open ends thereof meets or exceeds a selected flow rate. The sleeve member is disposed at least partially within the tubular body.

In yet further embodiments, the present invention includes methods of moving at least one blade of an earth-boring tool. Fluid may be flowed through a sleeve member disposed within a tubular body of an earth-boring tool at a first flow rate below a selected flow rate. The flow rate may be increased from the first flow rate at least to the selected flow rate to cause the fluid flowing through the sleeve member to move at least one movable restriction member disposed within the sleeve member from a first position to a second position in which the at least one movable restriction member restricts the flow of fluid through the sleeve member. The pressure of fluid within the sleeve member may be increased responsive to restriction of the flow of fluid through the sleeve member by the at least one movable restriction member, and the at least one blade of the earth-boring tool may be moved from a retracted position to an extended position responsive to the increase in the pressure of the fluid within the sleeve member.

BRIEF DESCRIPTION OF THE DRAWINGS

While the specification concludes with claims particularly pointing out and distinctly claiming what are regarded as embodiments of the invention, various features and advantages of embodiments of the invention may be more readily ascertained from the following description of some embodiments of the invention, when read in conjunction with the accompanying drawings, in which:

DETAILED DESCRIPTION

The illustrations presented herein are, in some instances, not actual views of any particular reamer tool, cutting element, or other feature of a reamer tool, but are merely idealized representations that are employed to describe embodiments of the present invention. Additionally, elements common between figures may retain the same numerical designation.

Figure 1:
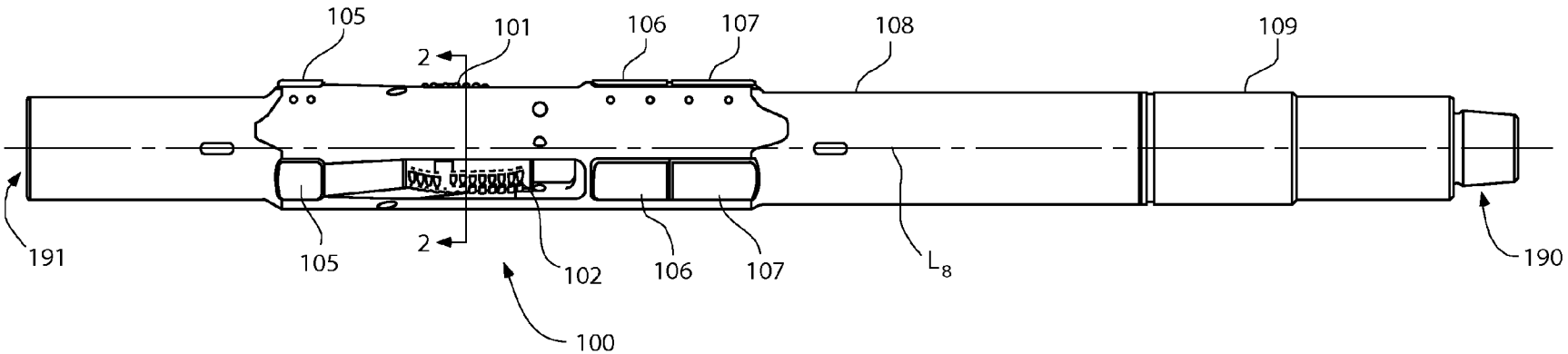
FIG. 1 is a side view of an embodiment of an expandable reamer apparatus of the invention.

An embodiment of an expandable reamer apparatus 100 of the invention is shown in FIG. 1. In some embodiments, the expandable reamer apparatus 100 may be generally the same as that described in United States Patent Application Publication No. 2008/0128175 A1, which application was filed Dec. 3, 2007 and entitled "Expandable Reamers for Earth-Boring Applications," the entire disclosure of which is incorporated herein by reference. The expandable reamer apparatus 100 of the present invention, however, may include a different actuation mechanism, as discussed in further detail hereinbelow.

The expandable reamer apparatus 100 may include a generally cylindrical tubular body 108 having a longitudinal axis $L_8$. The tubular body 108 of the expandable reamer apparatus 100 may have a lower end 190 and an upper end 191. The terms "lower" and "upper," as used herein with reference to the ends 190, 191, refer to the typical positions of the ends 190, 191 relative to one another when the expandable reamer apparatus 100 is positioned within a well bore. The lower end 190 of the tubular body 108 of the expandable reamer apparatus 100 may include a set of threads (e.g., a threaded male pin member) for connecting the lower end 190 to another section of a drill string or another component of a bottom-hole assembly (BHA), such as, for example, a drill collar or collars carrying a pilot drill bit for drilling a well bore. Similarly, the upper end 191 of the tubular body 108 of the expandable reamer apparatus 100 may include a set of threads (e.g., a threaded female box member) for connecting the upper end 191 to another section of a drill string or another component of a bottom-hole assembly (BHA).

Figure 11:
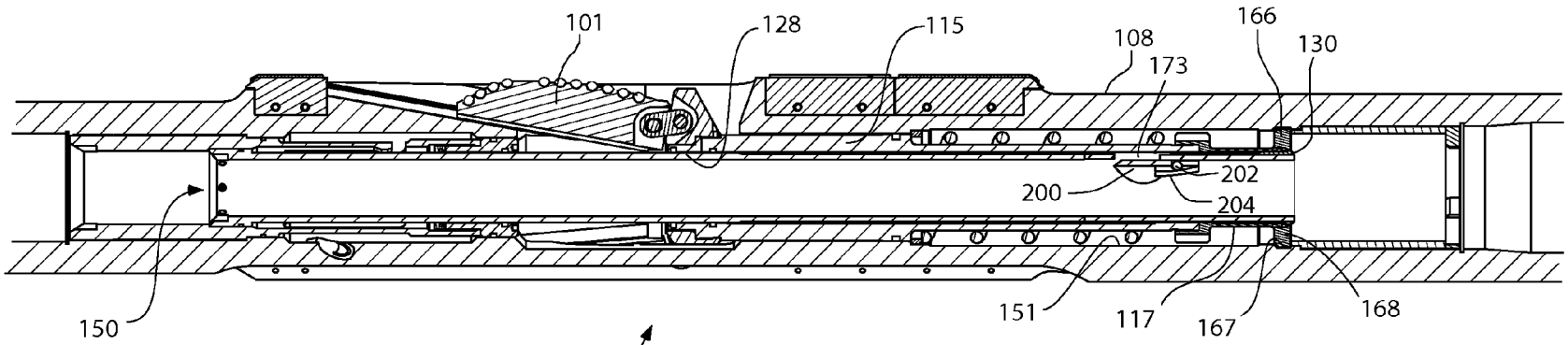
FIG. 11 shows a partial, longitudinal cross-sectional illustration of an embodiment of the expandable reamer apparatus in a closed, or retracted, initial tool position.

Three sliding cutter blocks or blades 101, 102, 103 (see FIG. 2) are positionally retained in circumferentially spaced relationship in the tubular body 108, as further described below, and may be provided at a position along the expandable reamer apparatus 100 intermediate the first lower end 190 and the second upper end 191. The blades 101, 102, 103 may be comprised of steel, tungsten carbide, a particle-matrix composite material (e.g., hard particles dispersed throughout a metal matrix material), or other suitable materials as known in the art. The blades 101, 102, 103 are retained in an initial, retracted position within the tubular body 108 of the expandable reamer apparatus 100 as illustrated in FIG. 11, but may be moved responsive to application of hydraulic pressure into the extended position (shown in FIG. 15) and moved into a retracted position (shown in FIG. 16) when desired, as will be described herein. The expandable reamer apparatus 100 may be configured such that the blades 101, 102, 103 engage the walls of a subterranean formation surrounding a well bore in which expandable reamer apparatus 100 is disposed to remove formation material when the blades 101, 102, 103 are in the extended position, but are not operable to so engage the walls of a subterranean formation within a well bore when the blades 101, 102, 103 are in the retracted position. While the expandable reamer apparatus 100 includes three blades 101, 102, 103, it is contemplated that one, two or more than three blades may be utilized to advantage. Moreover, while the blades 101, 102, 103 are symmetrically circumferentially positioned about the longitudinal axis $L_8$ along the tubular body 108, the blades 101, 102, 103 may also be positioned circumferentially asymmetrically, as well as asymmetrically about the longitudinal axis $L_8$.

Figure 2:
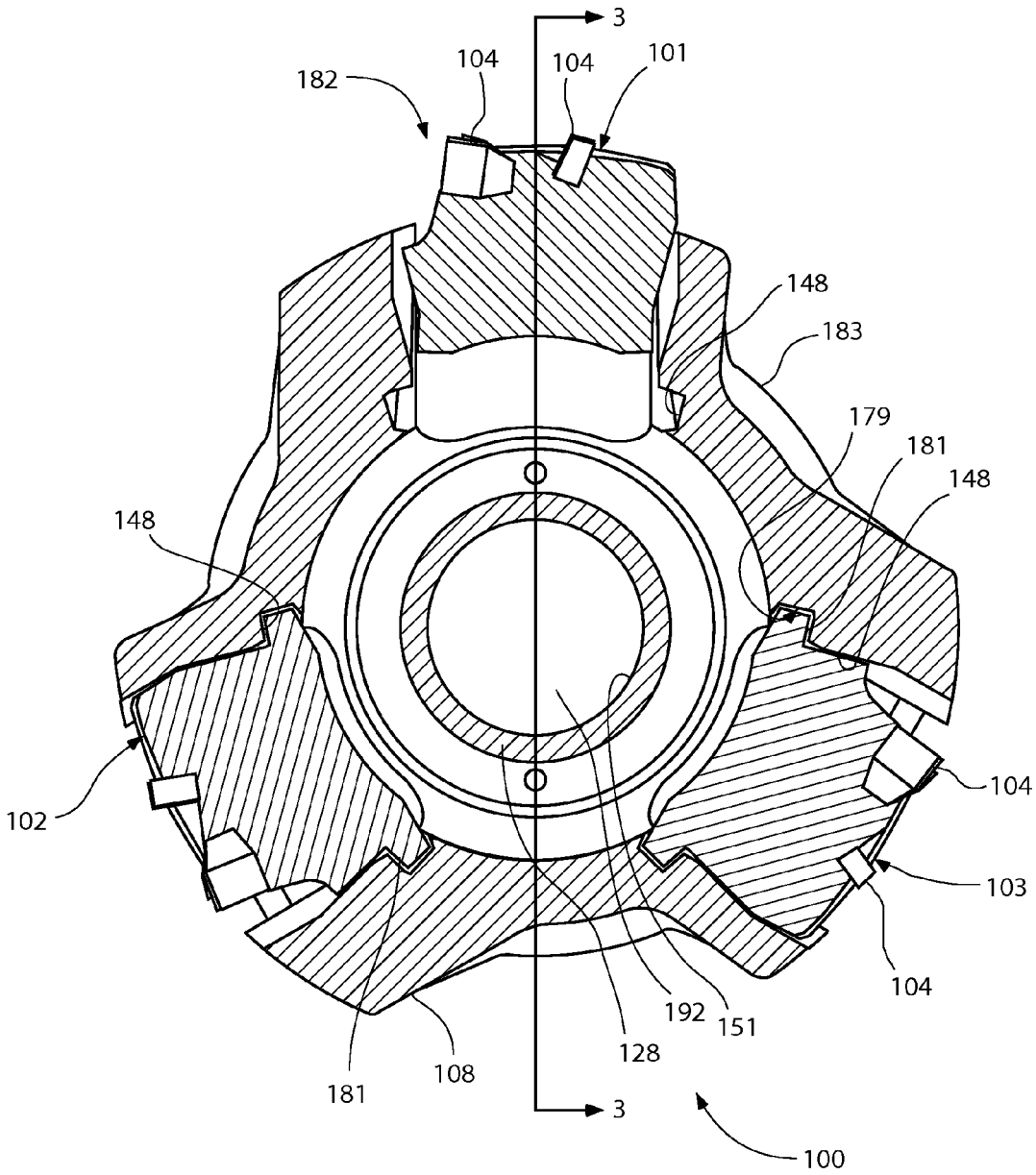
FIG. 2 shows a transverse cross-sectional view of the expandable reamer apparatus as indicated by section line 2-2 in FIG. 1.

FIG. 2 is a cross-sectional view of the expandable reamer apparatus 100 shown in FIG. 1 taken along section line 2-2 shown therein. As shown in FIG. 2, the tubular body 108 encloses a fluid passageway 192 that extends longitudinally through the tubular body 108. The fluid passageway 192 directs fluid substantially through an inner bore 151 of the tubular body 108 (and an inner bore of a traveling sleeve 128) in bypassing relationship to substantially shield the blades 101, 102, 103 from exposure to drilling fluid, particularly in the lateral direction, or normal to the longitudinal axis $L_8$ (FIG. 1). Advantageously, the particulate-entrained fluid is less likely to cause build-up or interfere with the operational aspects of the expandable reamer apparatus 100 by shielding the blades 101, 102, 103 from exposure with the fluid. However, it is recognized that beneficial shielding of the blades 101, 102, 103 is not necessary to the operation of the expandable reamer apparatus 100 where, as explained in further detail below, the operation (i.e., extension from the initial position, the extended position and the retracted position), occurs by an axially directed force that is the net effect of the fluid pressure and spring bias forces. In this embodiment, the axially directed force directly actuates the blades 101, 102, 103 by axially influencing the actuating means, such as a push sleeve 115 (shown in FIG. 3) for example, and without limitation, as better described herein below.

Referring to FIG. 2, to better describe aspects of the invention, blades 102 and 103 are shown in the initial or retracted positions, while blade 101 is shown in the outward or extended position. The expandable reamer apparatus 100 may be configured such that the outermost radial or lateral extent of each of the blades 101, 102, 103 is recessed within the tubular body 108 when in the initial or retracted positions so it may not extend beyond the greatest extent of outer diameter of the tubular body 108. Such an arrangement may protect the blades 101, 102, 103 as the expandable reamer apparatus 100 is disposed within a casing of a borehole, and may allow the expandable reamer apparatus 100 to pass through such casing within a borehole. In other embodiments, the outermost radial extent of the blades 101, 102, 103 may coincide with or slightly extend beyond the outer diameter of the tubular body 108. As illustrated by blade 101, the blades 101, 102, 103 may extend beyond the outer diameter of the tubular body 108 when in the extended position, to engage the walls of a borehole in a reaming operation.

Figure 3:
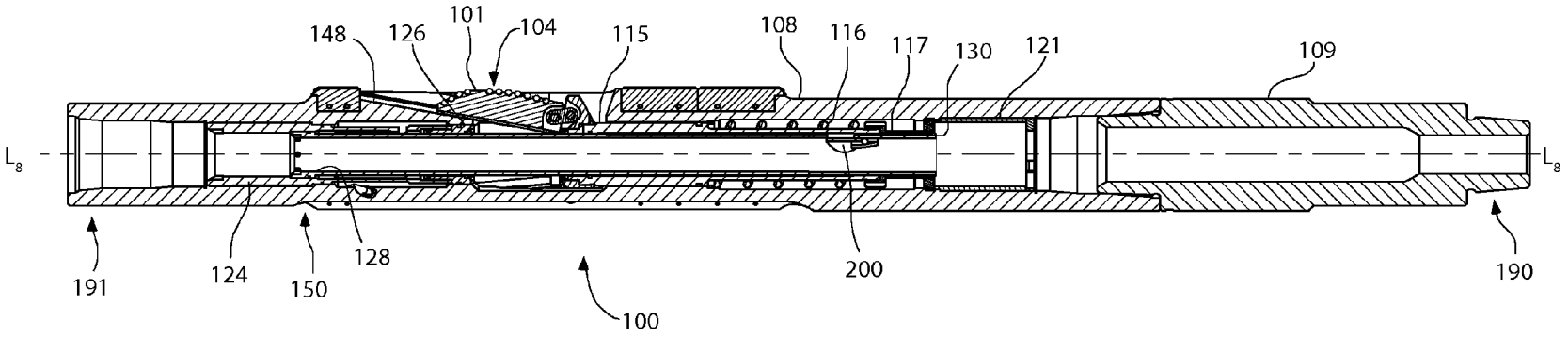
FIG. 3 shows a longitudinal cross-sectional view of the expandable reamer apparatus shown in FIG. 1.
Figure 4:
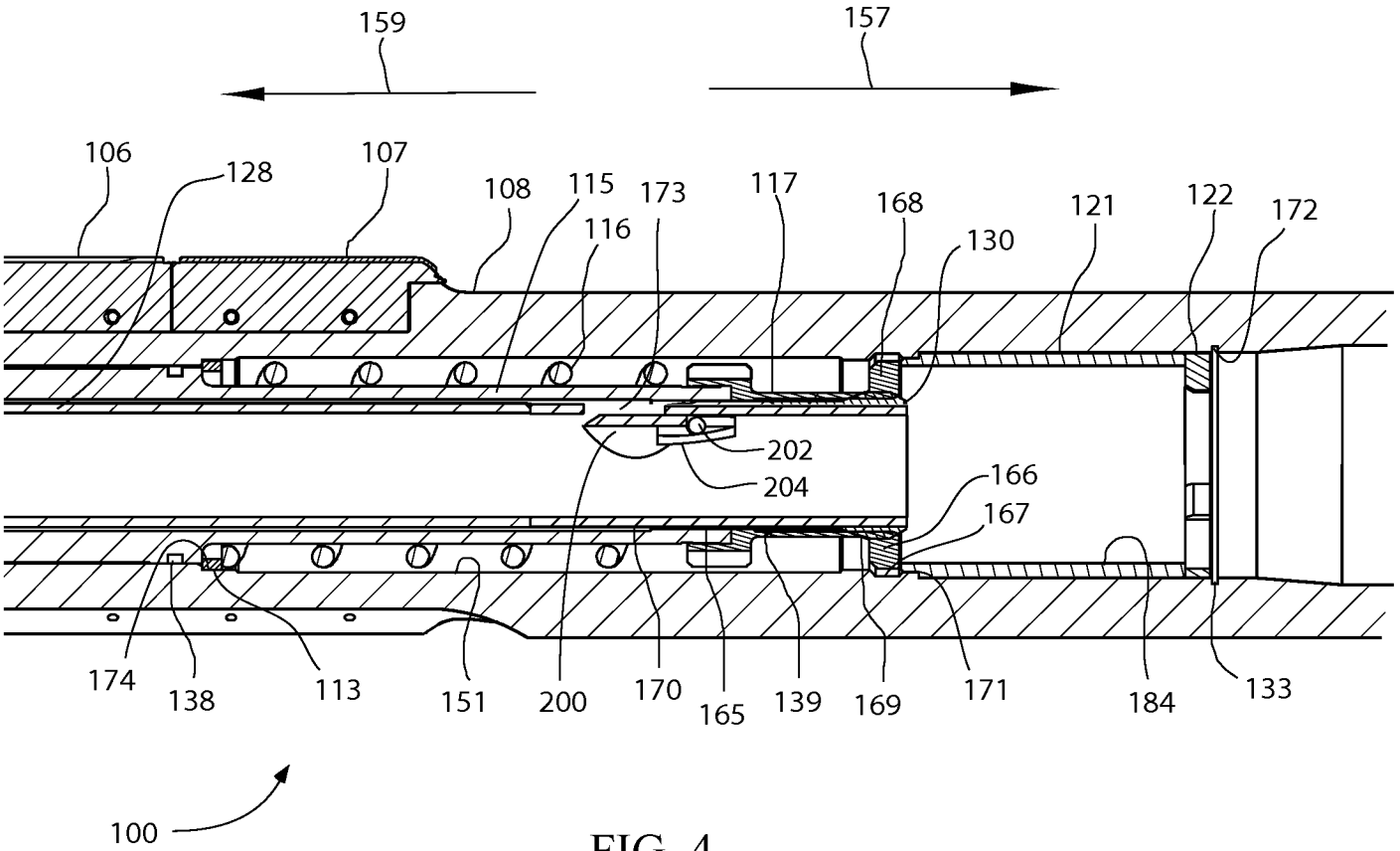
FIG. 4 shows an enlarged cross-sectional view of another portion of the expandable reamer apparatus shown in FIG. 3.
Figure 5:
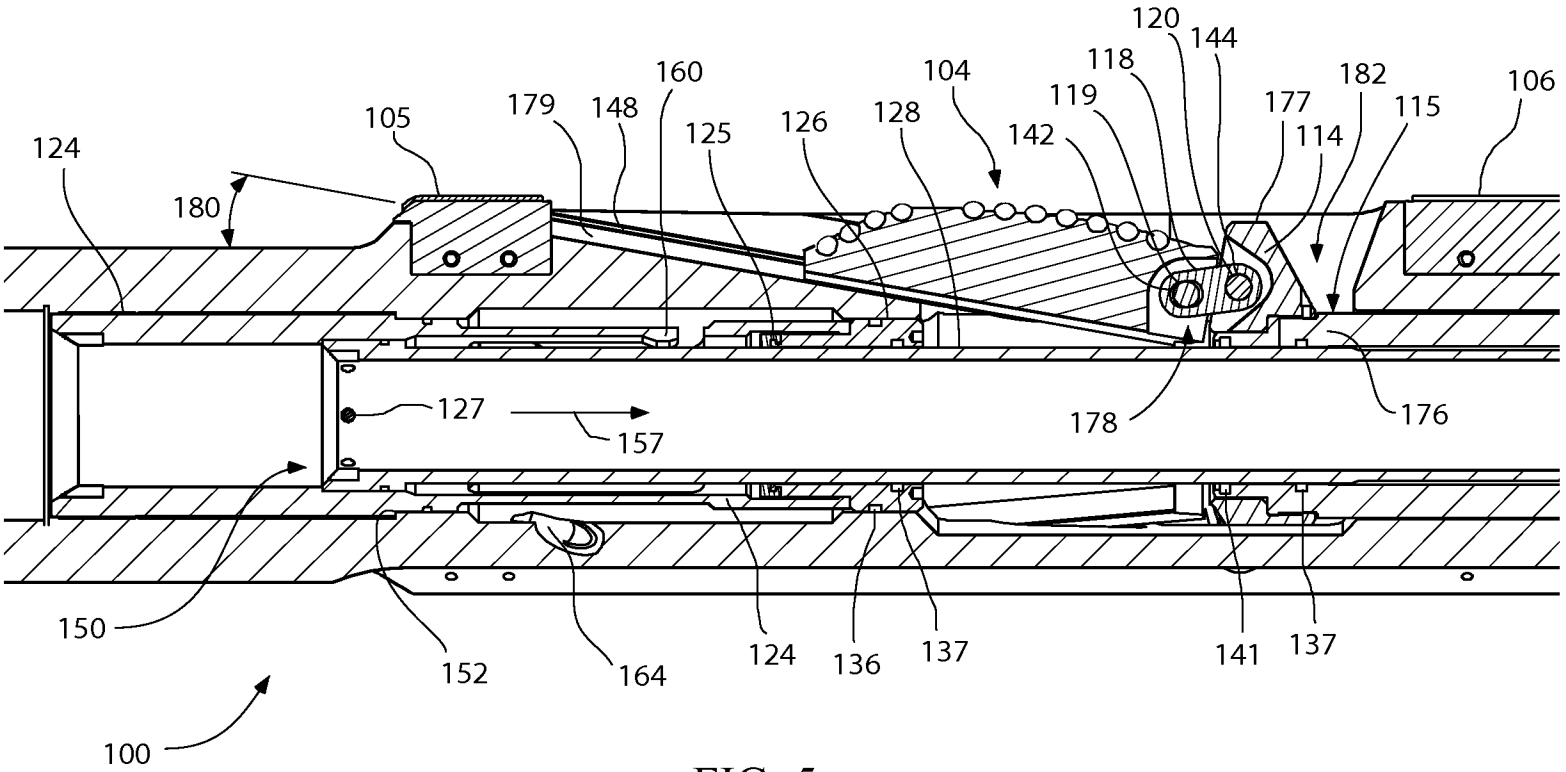
FIG. 5 shows an enlarged cross-sectional view of yet another portion of the expandable reamer apparatus shown in FIG. 3.
Figure 6:
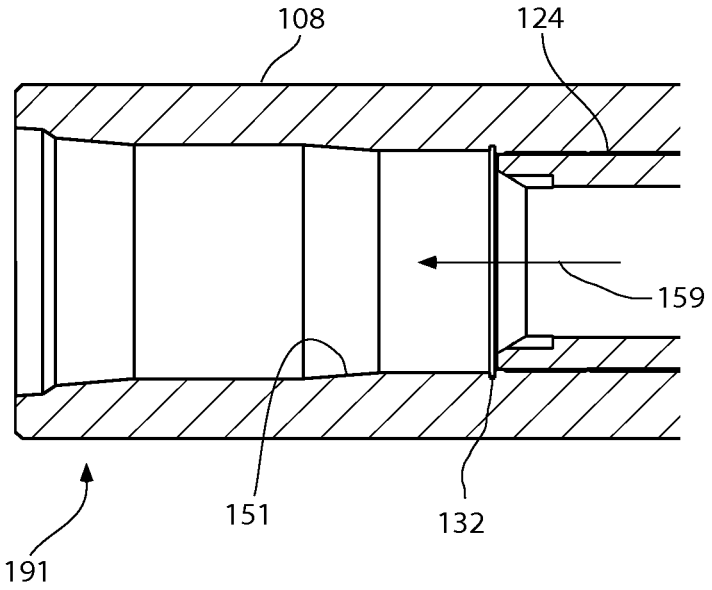
FIG. 6 shows an enlarged cross-sectional view of a further portion of the expandable reamer apparatus shown in FIG. 3.

FIG. 3 is another cross-sectional view of the expandable reamer apparatus 100 shown in FIGS. 1 and 2 taken along section line 3-3 shown in FIG. 2. Reference may also be made to FIGS. 4-6, which show enlarged partial longitudinal cross-sectional views of various portions of the expandable reamer apparatus 100 shown in FIG. 3. Reference may also be made back to FIGS. 1 and 2, as desired. The three sliding cutter blocks or blades 101, 102, 103 may be retained in three blade tracks 148 formed in the tubular body 108. The blades 101, 102, 103 each carry a plurality of cutting elements 104 for engaging the material of a subterranean formation defining the wall of an open borehole when the blades 101, 102, 103 are in an extended position (shown in FIG. 15). The cutting elements 104 may be polycrystalline diamond compact (PDC) cutters or other cutting elements known in the art.

Figure 7:
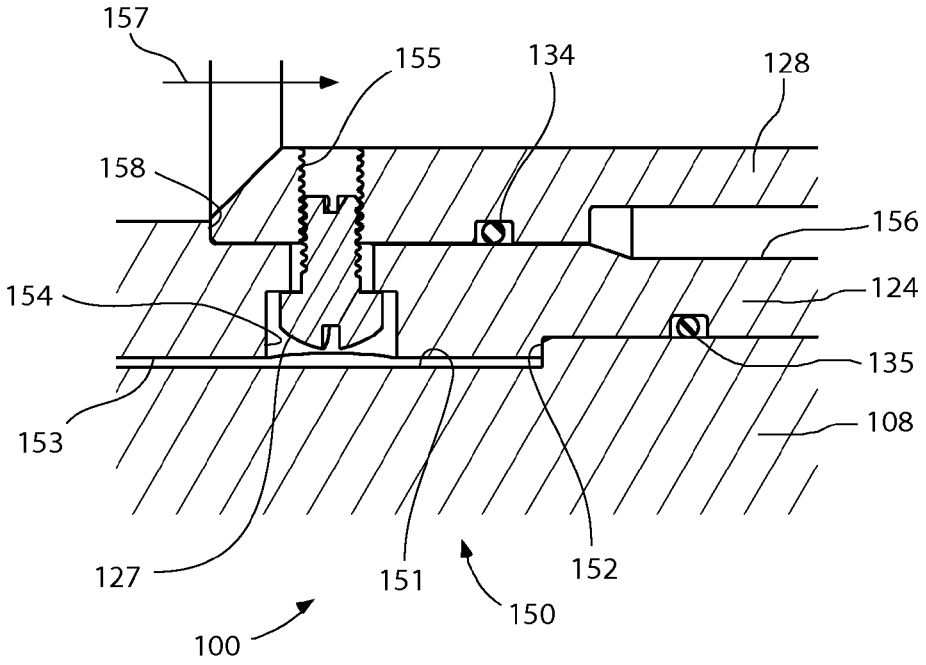
FIG. 7 shows a cross-sectional view of a shear assembly of an embodiment of the expandable reamer apparatus.

The expandable reamer apparatus 100 may include a shear assembly 150 for retaining the expandable reamer apparatus 100 in the initial position by securing the traveling sleeve 128 toward the upper end 191 of the tubular body 108. Reference may also be made to FIG. 7, showing a partial view of the shear assembly 150. The shear assembly 150 includes an uplock sleeve 124, some number of shear screws 127 and the traveling sleeve 128. The uplock sleeve 124 is retained within the inner bore 151 of the tubular body 108 between a lip 152 and a retaining ring 132 (shown in FIG. 6). An O-ring seal 135 may be used to prevent fluid from flowing between the outer bore 153 of the uplock sleeve 124 and the inner bore 151 of the tubular body 108. The uplock sleeve 124 includes shear slots 154 for retaining each of the shear screws 127, where, in the current embodiment of the invention, each shear screw 127 is threaded into a shear port 155 of the traveling sleeve 128. The shear screws 127 hold the traveling sleeve 128 within the inner bore 156 of the uplock sleeve 124 to conditionally prevent the traveling sleeve 128 from axially moving in a downhole direction 157 (i.e., toward the lower end 190 of the expandable reamer apparatus 100). The uplock sleeve 124 includes an inner lip 158 (as shown in FIG. 7) to prevent the traveling sleeve 128 from moving in the uphole direction 159 (i.e., toward the upper end 191 of the expandable reamer apparatus 100). An O-ring seal 134 provides a seal between the traveling sleeve 128 and the inner bore 156 of the uplock sleeve 124. When the shear screws 127 are sheared, the traveling sleeve 128 is allowed to axially travel within the tubular body 108 in the downhole direction 157. Advantageously, the portions of the shear screws 127 when sheared are retained within the uplock sleeve 124 and the traveling sleeve 128 in order to prevent the portions from becoming loose or being lodged in other components when drilling the borehole. While shear screws 127 are shown, other shear elements may be used to advantage, for example, without limitation, a shear rod, a shear wire and a shear pin. Optionally, other shear elements may include a structure for positive retention within constituent components after being exhausted, similar in manner to the shear screws 127 of the current embodiment of the invention.

Figure 15:
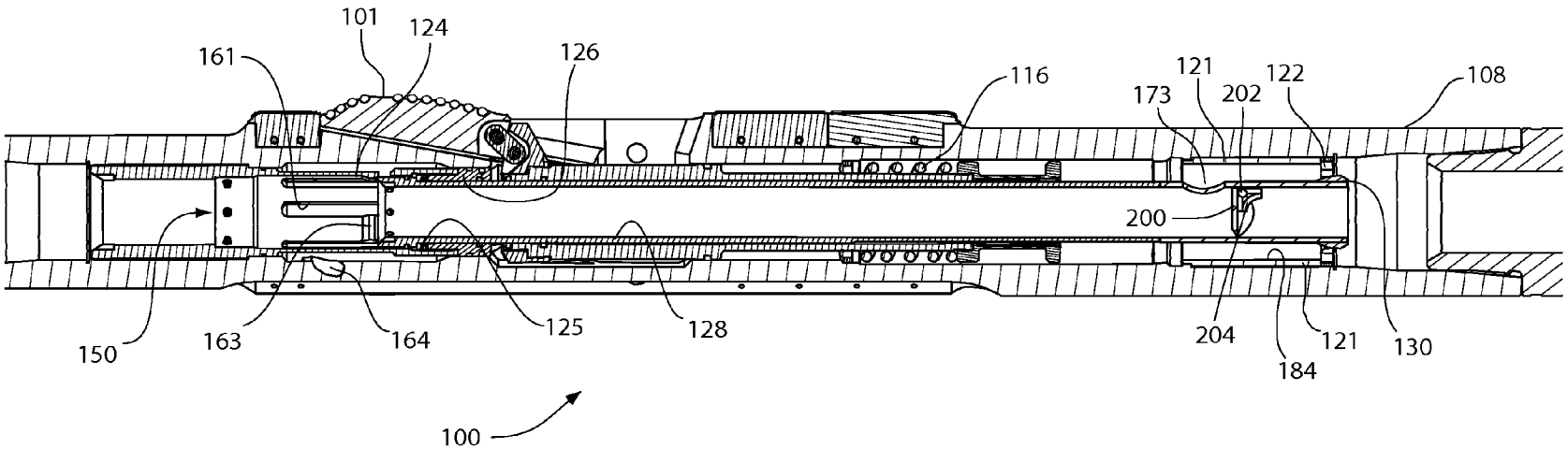
FIG. 15 shows a partial, longitudinal cross-sectional illustration of the expandable reamer apparatus of FIG. 11 in which the blades (one depicted) are held in the fully extended position by the push sleeve under the influence of fluid pressure and the traveling sleeve moves into the retained position.

With reference to FIGS. 5 and 15, uplock sleeve 124 further includes a collet 160 that axially retains a seal sleeve 126 between the inner bore 151 of the tubular body 108 and an outer bore of the traveling sleeve 128. The uplock sleeve 124 also includes one or more ears 163 and one or more ports 161 axially spaced there around. When the traveling sleeve 128 is positioned a sufficient axial distance in downhole direction 157, the one or more ears 163 spring radially inward to lock the motion of the traveling sleeve 128 between the ears 163 of the uplock sleeve 124 and a shock absorbing member 125 mounted upon an upper end of the seal sleeve 126. Also, as the traveling sleeve 128 positions a sufficient axial distance in the downhole direction 157, the one or more ports 161 of the uplock sleeve 124 are fluidly exposed allowing fluid to communicate with a nozzle intake port 164 from the fluid passageway 192 (see FIG. 2). The shock absorbing member 125 of the seal sleeve 126 provides spring retention of the traveling sleeve 128 with the ears 163 of the uplock sleeve 124 and also mitigates impact shock caused by the traveling sleeve 128 when its motion is stopped by the seal sleeve 126.

Shock absorbing member 125 may comprise a flexible or compliant material, such as, for instance, an elastomer or other polymer. In one embodiment, shock absorbing member 125 may comprise a nitrile rubber. Utilizing a shock absorbing member 125 between the traveling sleeve 128 and seal sleeve 126 may reduce or prevent permanent deformation of at least one of the traveling sleeve 128 and seal sleeve 126 that may otherwise occur due to impact therebetween.

It should be noted that any sealing elements or shock absorbing members disclosed herein that are included within expandable reamer apparatus 100 may comprise any suitable material as known in the art, such as, for instance, a polymer or elastomer. Optionally, a material comprising a sealing element may be selected for relatively high temperature (e.g., about 400° F. (204.4° C.) or greater) use. For instance, seals may be comprised of TEFLON®, polyetheretherketone (PEEK) material, another type of polymer material, which may be an elastomer. In additional embodiments, the seals described herein may comprise a metal to metal seal suitable for expected borehole conditions. Specifically, any sealing element or shock absorbing member disclosed herein, such as the shock absorbing member 125 and the seals 134 and 135 discussed hereinabove, or sealing elements discussed below, such as the seal 136, or other sealing elements included by an expandable reamer apparatus of the invention may comprise a material configured for relatively high temperature use, as well as for use in highly corrosive borehole environments.

The seal sleeve 126 includes an O-ring seal 136 that provides a seal between the seal sleeve 126 and the inner bore 151 of the tubular body 108, and a T-seal 137 that provides a seal between the seal sleeve 126 and the outer bore of the traveling sleeve 128, which completes fluid sealing between the traveling sleeve 128 and the nozzle intake port 164. Furthermore, the seal sleeve 126 axially aligns, guides and supports the traveling sleeve 128 within the tubular body 108. Moreover, the seals 136 and 137 of seal sleeve 126 and traveling sleeve 128 may also prevent hydraulic fluid from leaking from within the expandable reamer apparatus 100 to outside the expandable reamer apparatus 100 by way of the nozzle intake port 164 prior to the traveling sleeve 128 being released from its initial position.

A downhole end 165 of the traveling sleeve 128 (see FIG. 4), which includes a seat stop sleeve 130, is aligned, axially guided and supported by an annular piston or lowlock sleeve 117. The lowlock sleeve 117 is axially coupled to a push sleeve 115 that is cylindrically retained between the traveling sleeve 128 and the inner bore 151 of the tubular body 108. When the traveling sleeve 128 is in the "ready" or initial position during drilling, the hydraulic pressure may act on the push sleeve 115 and upon the lowlock sleeve 117 between the outer bore of the traveling sleeve 128 and the inner bore 151 of the tubular body 108. With or without hydraulic pressure, when the expandable reamer apparatus 100 is in the initial position, the push sleeve 115 is prevented from moving in the uphole direction 159 by a lowlock assembly (i.e., one or more dogs 166 of the lowlock sleeve 117).

The dogs 166 are positionally retained between an annular groove 167 in the inner bore 151 of the tubular body 108 and the seat stop sleeve 130. Each dog 166 of the lowlock sleeve 117 is a collet or locking dog latch having an expandable detent 168 that may engage the groove 167 of the tubular body 108 when compressively engaged by the seat stop sleeve 130. The dogs 166 hold the lowlock sleeve 117 in place and prevent the push sleeve 115 from moving in the uphole direction 159 until the "end" or seat stop sleeve 130, with its larger outer diameter 169, travels beyond the lowlock sleeve 117 allowing the dogs 166 to retract axially inward toward the smaller outer diameter 170 of the traveling sleeve 128. When the dogs 166 retract axially inward they may be disengaged from the groove 167 of the tubular body 108, allowing the push sleeve 115 to move responsive to hydraulic pressure primarily in the axial direction (i.e., in the uphole direction 159).

The shear screws 127 of the shear assembly 150, retaining the traveling sleeve 128 and the uplock sleeve 124 in the initial position, are used to provide or create a trigger that releases the traveling sleeve 128 when pressure builds to a predetermined, threshold value. When the hydraulic pressure within the expandable reamer apparatus 100 is increased above a threshold level, the shear screws 127 of the shear assembly 150 will fail, thereby allowing the traveling sleeve 128 to travel in the longitudinal direction with the expandable reamer apparatus 100, as described below. The predetermined threshold value at which the shear screws 127 shear under drilling fluid pressure within expandable reamer apparatus 100 may be, for example, 1,000 psi, or even 2,000 psi. It is recognized that the pressure may range to a greater or lesser extent than presented herein to trigger the expandable reamer apparatus 100. Optionally, it is recognized that a greater pressure at which the shear screws 127 will shear may be provided to allow the spring 116 to be conditionally configured and biased to a greater extent in order to further provide desired assurance of blade retraction upon release of hydraulic fluid.

The traveling sleeve 128 includes an elongated cylindrical wall. The longitudinal ends of the traveling sleeve 128 are open, as previously discussed, to allow fluid to flow through the traveling sleeve 128 between the open ends thereof. Furthermore, as shown in FIG. 4, one or more fluid ports 173 (holes, apertures, etc.) extend laterally through the elongated cylindrical wall of the traveling sleeve 128. For example, a fluid port 173 may be provided proximate the downhole end 165 of the traveling sleeve 128.

As shown in FIG. 4, at least one movable restriction member 200 may be disposed with the traveling sleeve 128 proximate the fluid port 173. As discussed below, the movable restriction member 200 may be used to initiate or "trigger" the action of the shear assembly 150, and, thereafter, actuate extension and retraction of the blades 101, 102, 103.

Figure 12:
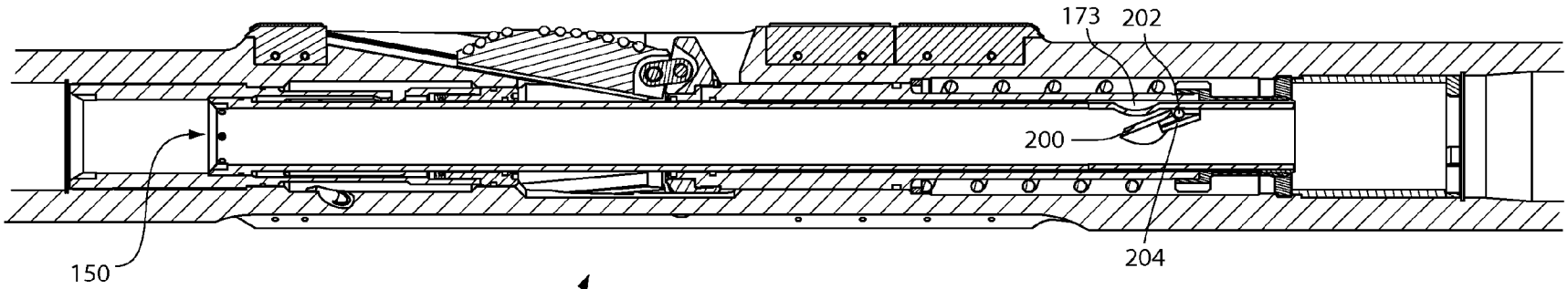
FIG. 12 shows a partial, longitudinal cross-sectional illustration of the expandable reamer apparatus of FIG. 11 in the initial tool position prior to actuation of the blades.
Figure 13:
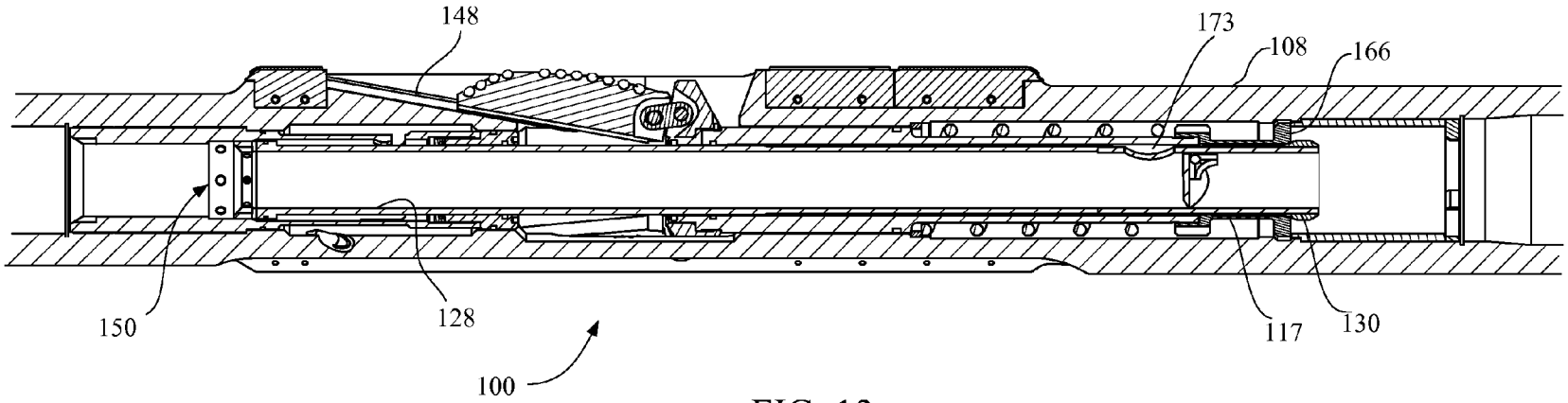
FIG. 13 shows a partial, longitudinal cross-sectional illustration of the expandable reamer apparatus of FIG. 11 in which a shear assembly is triggered as pressure is accumulated and a traveling sleeve begins to move down within the apparatus, leaving the initial tool position.
Figure 14:
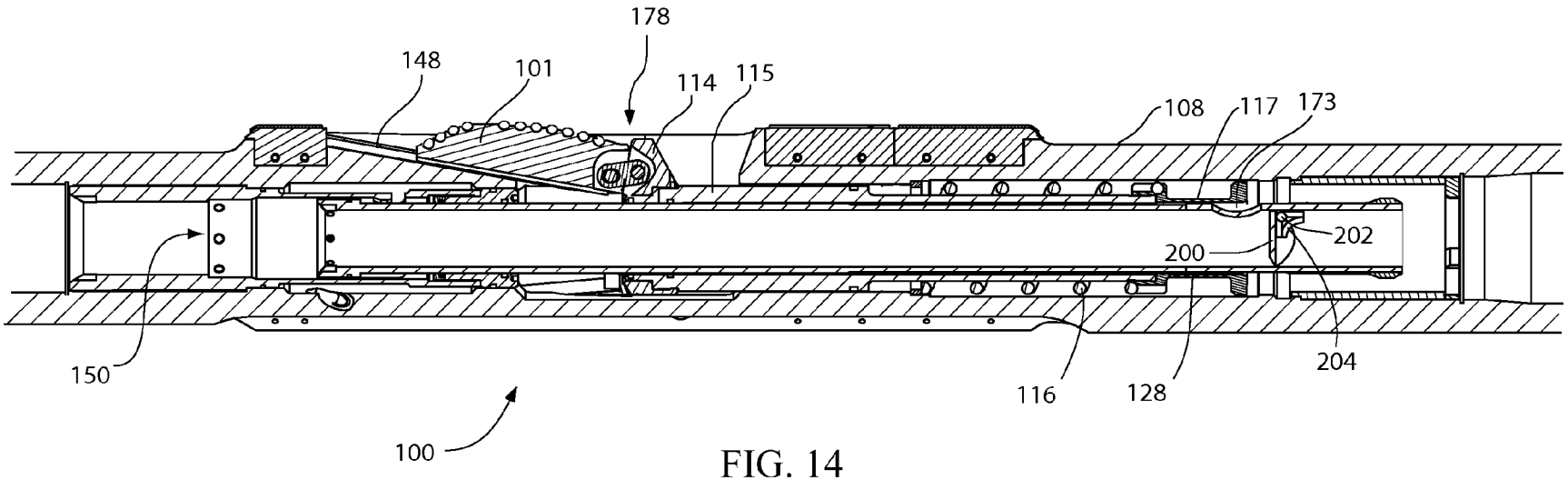
FIG. 14 shows a partial, longitudinal cross-sectional illustration of the expandable reamer apparatus of FIG. 11 in which the traveling sleeve moves toward a lower, retained position while a blade being urged by a push sleeve under the influence of fluid pressure moves toward an extended position.

The movable restriction member 200 may comprise a flap or other type of body that is movable between a first position, which is shown in FIGS. 3, 11, and 15, and a second position shown in FIGS. 13 and 14. The movable restriction member 200 is shown in an intermediate position between the first position and the second position in FIG. 12. The movable restriction member 200 may be configured to enable at least substantially unrestricted flow of drilling fluid through the open downhole end 165 of the traveling sleeve 128 in the first position shown in FIGS. 3, 11, and 15, and to restrict the flow of drilling fluid through the open downhole end 165 of the traveling sleeve 128, and to drive drilling fluid out through the one or more fluid ports 173 extending laterally through the cylindrical wall of the traveling sleeve 128, when the movable restriction member 200 is disposed in the second position shown in FIG. 12.

In the first position shown in FIGS. 3, 11, and 15, fluid flow through the traveling sleeve 128 between the open ends thereof is generally unimpeded, while fluid flow through the fluid port 173 is generally impeded. In other words, the fluid path extending through the traveling sleeve 128 is substantially unobstructed (unrestricted) by the movable restriction member 200 when the movable restriction member 200 is in the first position, and fluid flow through the fluid port 173 is substantially obstructed (restricted) by the movable restriction member 200 when the movable restriction member 200 is in the first position.

In the second position shown in FIGS. 13 and 14, fluid flow through the traveling sleeve 128 between the open ends thereof is generally impeded, while fluid flow through the fluid port 173 is generally unimpeded. In other words, the fluid path extending through the traveling sleeve 128 is substantially obstructed (restricted) by the movable restriction member 200 when the movable restriction member 200 is in the second position, and fluid flow through the fluid port 173 is substantially unobstructed (unrestricted) by the movable restriction member 200 when the movable restriction member 200 is in the second position.

The movable restriction member 200 may comprise a metal body (e.g., a sheet or layer of metal) having an arcuate shape that generally conforms to an inner wall of the tubular body of the traveling sleeve 128 when the restriction member 200 is in the first position. The movable restriction member 200 may be formed by, for example, bending a generally flat, planar sheet of metal to a desired shape. For example, the movable restriction member 200 may comprise a structure formed by shaping (e.g., bending) a generally flat, planar sheet of metal having a generally circular or elliptical peripheral edge to conform to the cylindrical inner surface of the traveling sleeve 128. In such embodiments, the movable restriction member 200 may have a partially cylindrical shape (i.e., the movable restriction member 200 may form a portion of a cylinder).

The movable restriction member 200 may be attached to the traveling sleeve 128. For example, the movable restriction member 200 may be attached to the traveling sleeve 128 using one or more hinges 202, as shown in FIGS. 11, 12, and 14-16. For example, the hinge 202 may be welded or otherwise fastened to each of the movable restriction member 200 and the traveling sleeve 128.

A biasing element 204 such as, for example, a leaf spring, may be used to bias the movable restriction member 200 to the first position. The biasing element 204 may abut against, and be attached to, each of the movable restriction member 200 and the traveling sleeve 128 so as to apply a force against the movable restriction member 200 that urges the movable restriction member 200 toward the first position.

The movable restriction member 200 may include at least one feature that causes the flow of fluid through the fluid passageway extending through the interior of the traveling sleeve 128 between the open ends thereof to exert a force on the movable restriction member 200 that urges the movable restriction member 200 from the first position toward the second position. In other words, the feature may result in a force that counteracts the force applied to the movable restriction member 200 by the biasing element 204. For example, a recess may be formed in the uphole end of the movable restriction member 200 that allows some fluid flowing through the traveling sleeve 128 to enter into a space between the movable restriction member 200 and the inner wall of the traveling sleeve 128.

As the flow rate of drilling fluid passing through the traveling sleeve 128 is increased, the magnitude of the force acting on the movable restriction member 200 may also increase in a proportional manner. Thus, as the flow rate is increased to a certain threshold flow rate, the movable restriction member 200 may begin to open (i.e., move from the first position to the second position). As the magnitude of the force acting on the movable restriction member 200 by the biasing element 204 may be a function of the angle between the movable restriction member 200 and the inner surface of the traveling sleeve 128, the movable restriction member 200 may begin to open at a first flow rate, but a higher, selected flow rate may be required to move the movable restriction member 200 completely to the second position. In some embodiments, the movable restriction member 200 and the biasing element 204 may be configured to cause the movable restriction member 200 to move completely to the second position when the flow rate of fluid through the traveling sleeve 128 is between about 900 gallons (3406.8 liters) per minute and about 1200 gallons (4542.4 liters) per minute.

Thus, in some embodiments, the movable restriction member 200 may be configured to be moved between the first and second positions by increasing and decreasing the flow rate of drilling fluid passing through the traveling sleeve 128, as opposed to by increasing and decreasing the pressure of the drilling fluid within the traveling sleeve 128 (without any accompanied change in flow rate).

When the movable restriction member 200 moves from the first position to the second position, the fluid or hydraulic pressure will build up within the expandable reamer apparatus 100, which will exert a downward force on the traveling sleeve 128. As the pressure and force increase beyond a predetermined threshold level, the shear screws 127 will shear. After the shear screws 127 shear, the traveling sleeve 128, along with the coaxially retained seat stop sleeve 130, will travel axially, under the influence of the hydraulic pressure, in the downhole direction 157 until the traveling sleeve 128 is again axially retained by the uplock sleeve 124 as described above or moves into a lower position. Thereafter, the fluid flow may be re-established through the fluid ports 173 in the traveling sleeve 128, which may be uncovered and unobstructed when the movable restriction member 200 is in the second position, as previously described. The movable restriction member 200 also may divert or direct fluid into the fluid ports 173 when the movable restriction member 200 is in the second position.

Also, in order to support the traveling sleeve 128 and mitigate vibration effects after the traveling sleeve 128 is axially retained, the seat stop sleeve 130 and the downhole end 165 of the traveling sleeve 128 may be retained in a stabilizer sleeve 122. Reference may also be made to FIGS. 4 and 15. The stabilizer sleeve 122 is coupled to the inner bore 151 of the tubular body 108 and retained between a retaining ring 133 and a protect sleeve 121, which is held by an annular lip 171 in the inner bore 151 of the tubular body 108. The retaining ring 133 is held within an annular groove 172 in the inner bore 151 of the tubular body 108. The protect sleeve 121 provides protection from the erosive nature of the hydraulic fluid to the tubular body 108 by allowing hydraulic fluid to flow through fluid ports 173 of the traveling sleeve 128, impinge upon the protect sleeve 121 and past the stabilizer sleeve 122 when the traveling sleeve 128 is retained therein.

After the traveling sleeve 128 travels sufficiently far enough to allow the dogs 166 of the lowlock sleeve 117 to be disengaged from the groove 167 of the tubular body 108, the dogs 166 of the lowlock sleeve 117 being connected to the push sleeve 115 may all move in the uphole direction 159. Reference may also be made to FIGS. 4, 5 and 14. In order for the push sleeve 115 to move in the uphole direction 159, the differential pressure between the inner bore 151 and the outer side 183 of the tubular body 108 caused by the hydraulic fluid flow must be sufficient to overcome the restoring force or bias of a compression spring 116. The compression spring 116, which resists the motion of the push sleeve 115 in the uphole direction 159, is retained on the outer surface 175 of the push sleeve 115 between a ring 113 attached in a groove 174 of the tubular body 108 and the lowlock sleeve 117. The push sleeve 115 may axially travel in the uphole direction 159 under the influence of the hydraulic fluid pressure, but is restrained from moving beyond the top lip of the ring 113 and beyond the protect sleeve 121 in the downhole direction 157. The push sleeve 115 may include a T-seal 138 that seals against the tubular body 108, a T-seal 137 that seals against the traveling sleeve 128, and a wiper seal 141 that seals against the traveling sleeve 128.

Figure 10:
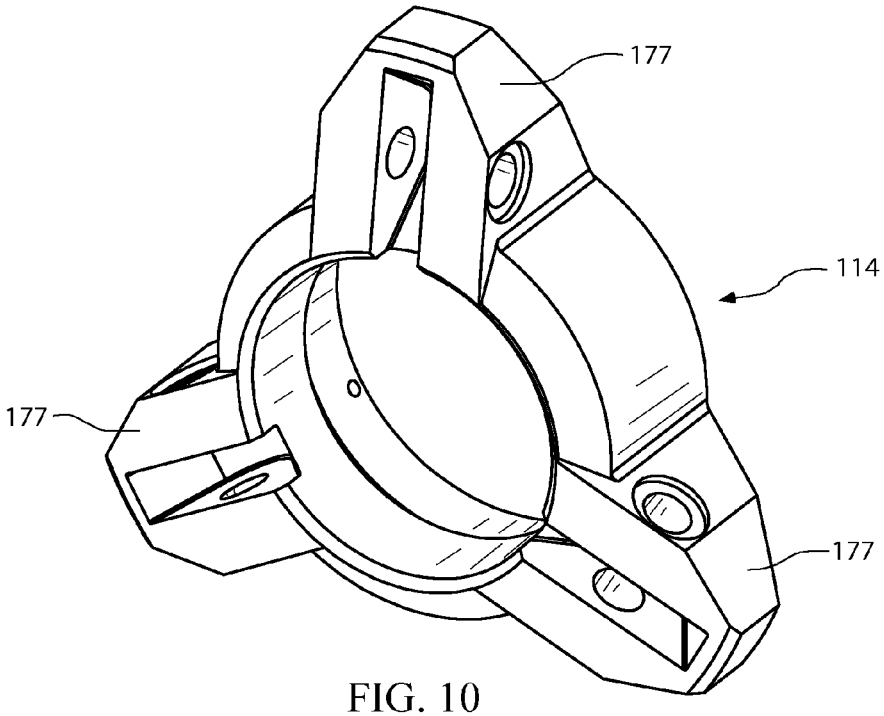
FIG. 10 shows a perspective view of a yoke of an embodiment of the expandable reamer apparatus.

The push sleeve 115 includes a yoke 114 located at or proximate an uphole section 176 of the push sleeve 115, the yoke 114 being coupled to the push sleeve 115 as shown in FIG. 5. The yoke 114 (also shown in FIG. 10) includes three aims 177, each arm 177 being coupled to one of the blades 101, 102, 103 by a pinned linkage 178. The arms 177 may include a shaped surface suitable for expelling debris as the blades 101, 102, 103 are retracted toward the retracted position. The shaped surface of the arms 177, in conjunction with the adjacent wall of the cavity of the tubular body 108, may provide included angles of approximately twenty degrees (20°), which is preferable to dislodge and remove any packed-in shale, and may further include low friction surface material to prevent sticking by formation cuttings and other debris. The pinned linkage 178 includes a linkage 118 coupling a blade to the arm 177, where the linkage 118 is coupled to the blade by a blade pin 119 and secured by a retaining ring 142, and the linkage 118 is coupled to the arm 177 by a yoke pin 120 which is secured by a cotter pin 144. The pinned linkage 178 allows the blades 101, 102, 103 to rotate relative to the arms 177 of the yoke 114, particularly as the actuating means directly transitions the blades 101, 102, 103 between the extended and retracted positions. Advantageously, the actuating means (i.e., the push sleeve 115, the yoke 114, and/or the linkage 178) directly retracts as well as extends the blades 101, 102, 103.

In order that the blades 101, 102, 103 may transition between the extended and retracted positions, they are each positionally coupled to one of the blade tracks 148 in the tubular body 108 as particularly shown in FIGS. 3 and 5. The blade track 148 includes a dovetail shaped groove 179 that axially extends along the tubular body 108 on a slope 180 extending at an acute angle with respect to the longitudinal axis $L_8$. Each of the blades 101, 102, 103 includes a dovetail shaped rail 181 that substantially matches the dovetail shaped groove 179 (FIG. 2) of the blade track 148 in order to slideably secure the blades 101, 102, 103 to the tubular body 108. When the push sleeve 115 is influenced by the hydraulic pressure, the blades 101, 102, 103 will be extended upward and outward through a blade passage port 182 into the extended position ready for cutting the formation. The blades 101, 102, 103 are pushed along the blade tracks 148 until the forward motion is stopped by the tubular body 108 or the upper stabilizer block 105 being coupled to the tubular body 108. In the upward-outward or fully extended position, the blades 101, 102, 103 are positioned such that the cutting elements 104 will enlarge a borehole in the subterranean formation by a prescribed amount. When hydraulic pressure provided by drilling fluid flow through expandable reamer apparatus 100 is released, the spring 116 will urge the blades 101, 102, 103 via the push sleeve 115 and the pinned linkage 178 into the retracted position. Should the assembly not readily retract via spring force, the tool may be pulled up the borehole and abutted against a casing shoe. When the tool is pulled against a casing shoe, the shoe may contact the blades 101, 102, 103 helping to urge or force them down the blade tracks 148, allowing the expandable reamer apparatus 100 to be retrieved from the borehole. In this respect, the expandable reamer apparatus 100 includes retraction assurance feature to further assist in removing the expandable reamer apparatus 100 from a borehole. The slope 180 of blade tracks 148 in this embodiment of the invention is ten degrees (10°), taken with respect to the longitudinal axis $L_8$ of the expandable reamer apparatus 100. While the slope 180 of the blade tracks 148 is ten degrees (10°), it may vary from a greater extent to a lesser extent than that illustrated. However, it may be desirable for the slope 180 to be less than about thirty-five degrees (35°). As the blades 101, 102, 103 are "locked" into the blade tracks 148 with the dovetail shaped rails 181 as they are axially driven into the extended position, looser dimensional tolerances may be permitted compared to conventional hydraulic reamers which require close tolerances between the blade pistons and the tubular body to radially drive the blade pistons into their extended position. Accordingly, the blades 101, 102, 103 may be more robust and less likely to bind or fail due to blockage from the fluid. In this embodiment of the invention, the blades 101, 102, 103 have ample clearance in the grooves 179 of the blade tracks 148, such as a 1/16 inch (0.0625 cm) clearance, more or less, between the dovetail shaped rail 181 and dovetail shaped groove 179. It is to be recognized that the term "dovetail" when making reference to the groove 179 or the rail 181 is not to be limiting, but is directed broadly toward structures in which each blade 101, 102, 103 is retained with the tubular body 108 of the expandable reamer apparatus 100, while further allowing the blades 101, 102, 103 to transition between two or more positions along the blade tracks 148 without binding or mechanical locking.

Figure 8:
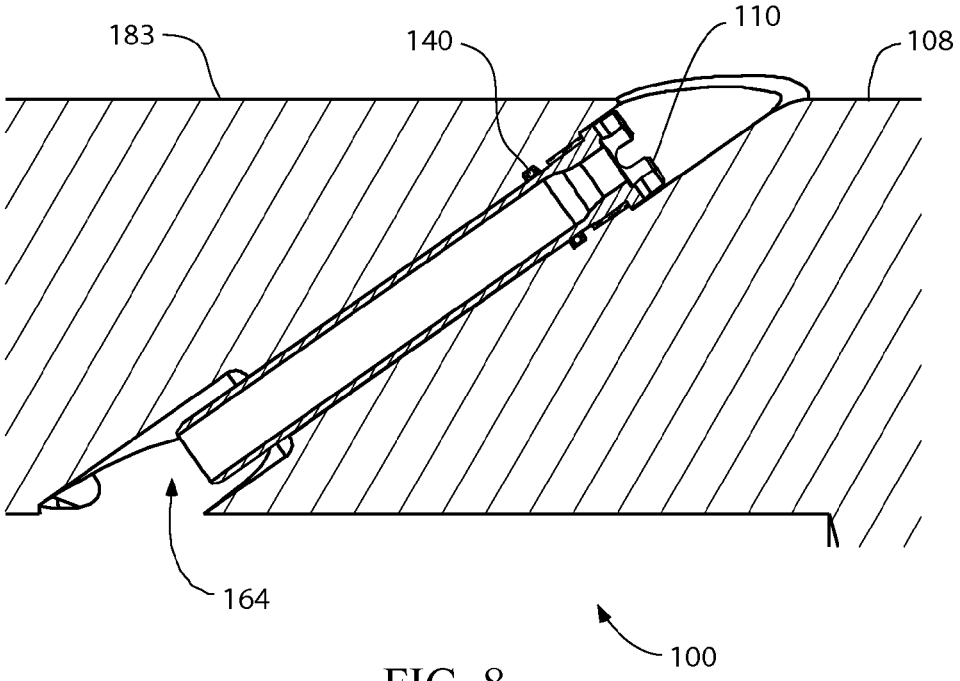
FIG. 8 shows a cross-sectional view of a nozzle assembly of an embodiment of the expandable reamer apparatus.
Figure 9:
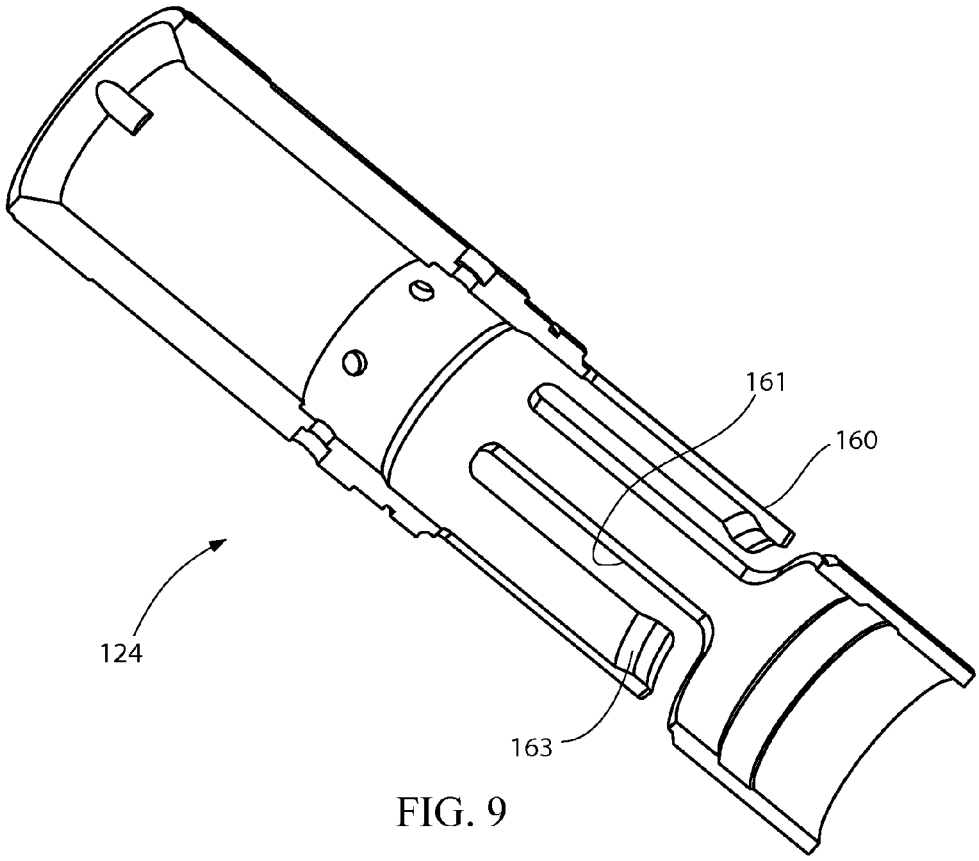
FIG. 9 shows a cross-sectional view of an uplock sleeve of an embodiment of the expandable reamer apparatus.

Also, the expandable reamer apparatus 100 may include tungsten carbide nozzles 110 as shown in FIG. 8. The nozzles 110 are provided to cool and clean the cutting elements 104 and clear debris from blades 101, 102, 103 during drilling. The nozzles 110 may include an O-ring seal 140 between each nozzle 110 and the tubular body 108 to provide a seal between the two components. As shown, the nozzles 110 are configured to direct drilling fluid toward the blades 101, 102, 103 in the downhole direction 157, but may be configured to direct fluid laterally or in the uphole direction 159.

The expandable reaming apparatus, or reamer, 100 is now described in terms of its operational aspects. Reference may be made to FIGS. 11-16, in particular, and optionally to FIGS. 1-10, as desirable. The expandable reamer apparatus 100 may be installed in a bottom-hole assembly above a pilot drill bit and, if included, above or below a measurement while drilling (MWD) device. The expandable reaming apparatus 100 may be incorporated into a rotary steerable system (RSS) and rotary closed loop system (RCLS), for example. Before "triggering" the expandable reamer apparatus 100, the expandable reamer apparatus 100 is maintained in an initial, retracted position as shown in FIG. 11. The traveling sleeve 128 prevents inadvertent extension of blades 101, 102, 103, as previously described, and is retained by the shear assembly 150 with shear screws 127 secured to the uplock sleeve 124 which is attached to the tubular body 108. While the traveling sleeve 128 is held in the initial position, the blade actuating means is prevented from directly actuating the blades 101, 102, 103 whether acted upon by biasing forces or hydraulic forces. The traveling sleeve 128 has, on its lower end, an enlarged end piece, the seat stop sleeve 130. This larger diameter seat stop sleeve 130 holds the dogs 166 of the lowlock sleeve 117 in a secured position, preventing the push sleeve 115 from moving upward under affects of differential pressure and activating the blades 101, 102, 103. The latch dogs 166 lock the latch or expandable detent 168 into a groove 167 in the inner bore 151 of the tubular body 108.

When it is desired to trigger the expandable reamer apparatus 100, the rate of flow of drilling fluid through the expandable reamer apparatus 100 is increased to exert a force against the movable restriction member 200 and cause the movable restriction member 200 to move from the first position shown in FIGS. 3, 11, and 15 to the second position shown in FIGS. 13 and 14. As the movable restriction member 200 moves to the second position and obstructs the flow of fluid through the traveling sleeve 128, the fluid pressure builds within the expandable reamer apparatus 100 above the movable restriction member 200.

Referring to FIG. 13, at a predetermined threshold pressure level, set by the number and individual shear strengths of the shear screws 127 (made of brass or other suitable material) installed initially in the expandable reamer apparatus 100, the shear screws 127 will fail in the shear assembly 150 and allow the traveling sleeve 128 to unseat and move downward. As the traveling sleeve 128 with the larger end of the seat stop sleeve 130 moves downward, the latch dogs 166 of the lowlock sleeve 117 are free to move inward toward the smaller diameter of the traveling sleeve 128 and become free of the tubular body 108.

Thereafter, as illustrated in FIG. 14, the lowlock sleeve 117 is attached to the pressure-activated push sleeve 115, which now moves upward under fluid pressure influence through the fluid ports 173 as the traveling sleeve 128 moves downward. As the fluid pressure is increased, the biasing force of the spring 116 is overcome, allowing the push sleeve 115 to move in the uphole direction 159. The push sleeve 115 is attached to the yoke 114, which is attached by pins and pinned linkage 178 to the three blades 101, 102, 103, which are now moved upwardly by the push sleeve 115. In moving upward, the blades 101, 102, 103 each follow a ramp or blade track 148 to which they are mounted, via a type of modified square dovetail-shaped groove 179 (shown in FIG. 2), for example.

Referring to FIG. 15, the stroke of the blades 101, 102, 103 is stopped in the fully extended position by upper hardfaced pads on the stabilizer block 105, for example. Optionally, as mentioned herein above, a customized stabilizer block may be assembled to the expandable reamer apparatus 100 prior to drilling in order to adjust and limit the extent to which the blades 101, 102, 103 may extend. With the blades 101, 102, 103 in the extended position, reaming a borehole may commence.

As reaming takes place with the expandable reamer apparatus 100, the lower and mid hardface pads 106, 107 help to stabilize the tubular body 108 as the cutting elements 104 of the blades 101, 102, 103 ream a larger borehole and the upper hardface pads also help to stabilize the top of the expandable reamer apparatus 100 when the blades 101, 102, 103 are in the retracted position.

After the traveling sleeve 128 moves downward, it comes to a stop with the fluid port 173 in the traveling sleeve 128 exiting against an inside wall 184 of the hardfaced protect sleeve 121, the hardfacing helping to prevent or minimize erosion damage from drilling fluid flow impinging thereupon. The upper end of the traveling sleeve 128 may become trapped or locked between the ears 163 of the uplock sleeve 124 and the shock absorbing member 125 of the seal sleeve 126 and the lower end of the traveling sleeve 128 is laterally stabilized by the stabilizer sleeve 122.

Figure 16:
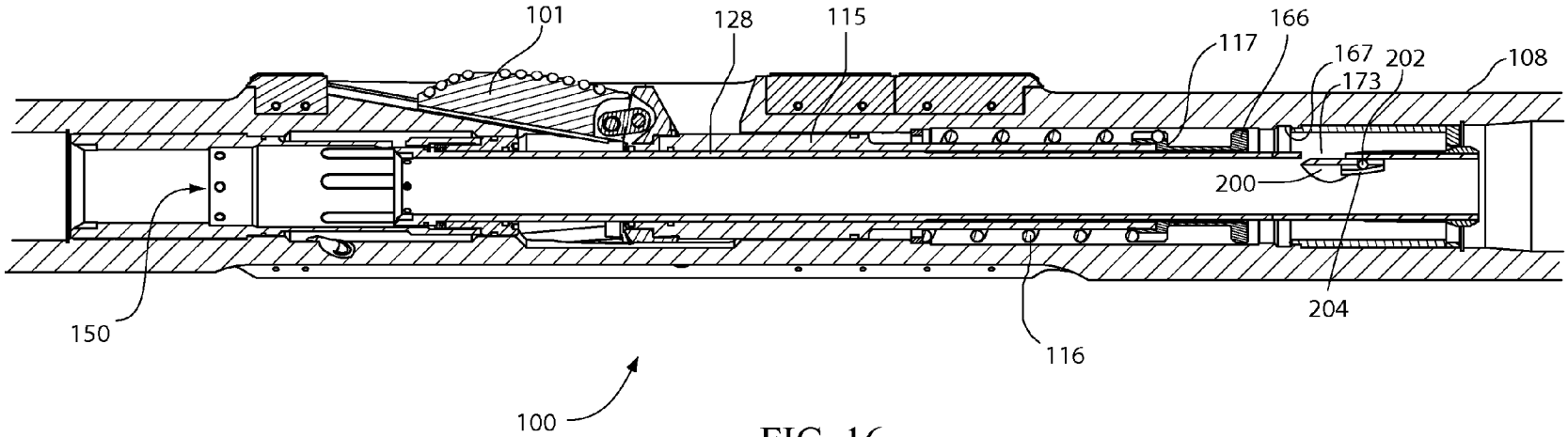
FIG. 16 shows a partial, longitudinal cross-sectional illustration of the expandable reamer apparatus of FIG. 11 in which the blades (one depicted) are retracted into a retracted position by a biasing spring when the fluid pressure is dissipated.

When drilling fluid pressure is released, the spring 116 will help drive the lowlock sleeve 117 and the push sleeve 115 with the attached blades 101, 102, 103 back downwardly and inwardly substantially to their original or initial position into the retracted position, as shown in FIG. 16. However, since the traveling sleeve 128 has moved to a downward locked position, the larger diameter seat stop sleeve 130 will no longer hold the latch dogs 166 out and in the groove 167, and, thus, the latch or lowlock sleeve 117 stays unlatched for subsequent operation or activation. Furthermore, the biasing element 204 may force the movable restriction member 200 back to the first position shown in FIGS. 3, 11, and 15.

Whenever the flow rate of the drilling fluid passing through the traveling sleeve 128 is elevated to or beyond a selected flow rate value, the movable restriction member 200 will move back to the second position shown in FIGS. 13 and 14, and the pressure within the expandable reamer apparatus 100 above the movable restriction member 200 may be increased to cause the push sleeve 115 with the yoke 114 and blades 101, 102, 103 to move upward with the blades 101, 102, 103 following the ramps or blade tracks 148 to again ream the borehole.

One advantage of embodiments of the present invention is that, after the traveling sleeve 128 is caused to move to the downhole position and the blades 101, 102, 103 are initially extended, after retraction of the blades 101, 102, 103, the movable restriction member 200 will return to the first position, and drilling with a pilot drill bit attached to the downhole end of the reamer apparatus 100 may resume while drilling fluid is pumped through the reamer apparatus 100 to the pilot drill bit without causing the blades 101, 102, 103 to again move into the extended position (i.e., without reaming), as long as the flow rate is maintained below that required to move the movable restriction member 200 to the second position. In other words, the drilling fluid may be caused to flow through the traveling sleeve 128 at a flow rate below the flow rate required to move the movable restriction member 200 completely to the second position while drilling a bore with a pilot drill bit attached to the reamer apparatus 100 and while the blades 101, 102, 103 are retracted. Such processes may not be feasible with conventional ball and ball trap actuation devices, such as those disclosed in U.S. Patent Application Publication No. 2008/0128175 A1.

In other embodiments of the invention, the traveling sleeve 128 may be sealed to prevent fluid flow from exiting the apparatus 100 through the blade passage ports 182, and after triggering, the seal may be maintained.

The expandable reamer apparatus 100 may include a lower saver sub 109 shown in FIG. 3 that connects to the lower box connection of the tubular body 108. Allowing the tubular body 108 to be a single piece design, the saver sub 109 enables the connection between the two to be stronger (e.g., has a higher makeup torque) than a conventional two piece tool having an upper and a lower connection. The saver sub 109, although not required, provides for more efficient connection to other downhole equipment or tools.

Optionally, one or more of the blades 101, 102, 103 may be replaced with stabilizer blocks having guides and rails as described herein for being received into grooves 179 of the blade track 148 in the expandable reamer apparatus 100, which may be used as expandable concentric stabilizer rather than a reamer, which may further be utilized in a drill string with other concentric reamers or eccentric reamers.

While the present invention has been described herein with respect to certain embodiments, those of ordinary skill in the art will recognize and appreciate that it is not so limited. Rather, many additions, deletions and modifications to the embodiments described herein may be made without departing from the scope of the invention as hereinafter claimed, including legal equivalents. In addition, features from one embodiment may be combined with features of another embodiment while still being encompassed within the scope of the invention as contemplated by the inventors.

What is claimed is:

1. A downhole tool for use in forming a borehole in a subterranean formation, comprising:

a tubular body;

at least one movable body carried by the tubular body, the at least one movable body configured to move between an activated position and a deactivated position;

a sleeve member disposed at least partially within the tubular body, the sleeve member comprising an elongated cylindrical wall having open ends allowing fluid to flow through the sleeve member, the elongated cylindrical wall having at least one fluid port extending therethrough; and at least one movable restriction member disposed within the sleeve member, the at least one movable restriction member being movable between a first position in which fluid flow through the sleeve member between the open ends thereof is generally unimpeded and fluid flow through the at least one fluid port extending through the elongated cylindrical wall of the sleeve member is generally impeded, and a second position in which fluid flow through the sleeve member between the open ends thereof is generally impeded and fluid flow through the at least one fluid port extending through the elongated cylindrical wall of the sleeve member is generally unimpeded, the at least one movable restriction member being biased toward the first position, the at least one movable restriction member configured to move substantially completely to the second position when a flow rate of fluid through the sleeve member between the open ends thereof meets or exceeds a threshold flow rate, wherein the at least one movable body is configured to move between the activated position and the deactivated position responsive to movement of the at least one movable restriction member between the first position and the second position.

2. The downhole tool of claim 1, wherein fluid pressure within the sleeve member rises responsive to movement of the at least one movable restriction member from the first position to the second position.

3. The downhole tool of claim 2, wherein the at least one movable body is configured to move from the deactivated position to the activated position responsive to the rise in fluid pressure within the sleeve member resulting from movement of the at least one movable restriction member from the first position to the second position.

4. The downhole tool of claim 3, further comprising a push sleeve disposed within the tubular body and coupled to the at least one movable body, the push sleeve configured to move responsive to the rise in fluid pressure within the sleeve member resulting from movement of the at least one movable restriction member from the first position to the second position.

5. The downhole tool of claim 1, wherein the threshold flow rate is at least about 900 gallons (3406.8 liters) per minute.

6. The downhole tool of claim 5, wherein the threshold flow rate is about 1200 gallons (4542.4 liters) per minute or less.

7. The downhole tool of claim 1, wherein the at least one movable restriction member comprises a metal.

8. The downhole tool of claim 1, wherein the at least one movable restriction member has an arcuate shape.

9. The downhole tool of claim 8, wherein the at least one movable restriction member has a partially cylindrical shape.

10. The downhole tool of claim 1, wherein the at least one movable restriction member has a generally circular or elliptical peripheral edge.

11. The downhole tool of claim 1, wherein the at least one movable restriction member is attached to the sleeve member by at least one hinge.

12. The downhole tool of claim 1, wherein the at least one movable restriction member is biased toward the first position by at least one spring.

13. The downhole tool of claim 1, further comprising at least one cutting element attached to the at least one movable body, the at least one cutting element projecting laterally beyond an outer surface of the tubular body when the at least one movable body is in the extended position, the at least one cutting element being recessed below the outer surface of the tubular body when the at least one movable body is in the retracted position.

14. The downhole tool of claim 13, wherein the downhole tool comprises an expandable reamer apparatus.

15. The downhole tool of claim 14, wherein the at least one movable body comprises a plurality of blades.

16. A method of using a downhole tool in forming a borehole in a subterranean formation, comprising:

flowing fluid through a sleeve member disposed within a tubular body of the downhole tool at a first flow rate below a threshold flow rate;

increasing the flow rate from the first flow rate at least to the threshold flow rate to cause the fluid flowing through the sleeve member to move at least one movable restriction member disposed within the sleeve member from a first position to a second position in which the at least one movable restriction member restricts the flow of fluid through the sleeve member;

increasing a pressure of fluid within the sleeve member responsive to restriction of the flow of fluid through the sleeve member by the at least one movable restriction member; and moving at least one movable body of the downhole tool from a deactivated position to an activated position responsive to the increase in the pressure of the fluid within the sleeve member.

17. The method of claim 16, further comprising reducing the pressure of fluid within the sleeve member to allow the at least one movable restriction member disposed within the sleeve member to move from the second position to the first position responsive to a force provided by a biasing element acting on the at least one movable restriction member.

18. The method of claim 16, wherein flowing the fluid through the sleeve member at the first flow rate below the threshold flow rate comprises flowing the fluid through the sleeve member at a flow rate below about 900 gallons (3406.8 liters) per minute.

19. The method of claim 18, wherein the threshold flow rate is between about 900 gallons (3406.8 liters) per minute and about 1200 gallons (4542.4 liters) per minute.

20. The method of claim 19, further comprising reaming a borehole using the downhole tool while the at least one movable body of the downhole tool is in the activated position.

* * * * *